United States Patent [19]

Fredrickson

[11] Patent Number: 4,936,565

[45] Date of Patent: Jun. 26, 1990

[54] DISPLAY DEVICE

[75] Inventor: Howard J. Fredrickson, Cannon Falls, Minn.

[73] Assignee: Cannon Equipment Company, Cannon Falls, Minn.

[21] Appl. No.: 245,487

[22] Filed: Sep. 19, 1988

[51] Int. Cl.[5] ..... A47F 7/00

[52] U.S. Cl. ..... 211/59.1; 248/220.3

[58] Field of Search ..... 248/220.3, 220.4, 221.1, 248/221.2; 40/605, 155, 657; 211/59.1, 54.1, 57.1, 94

[56] References Cited

U.S. PATENT DOCUMENTS

| | | | |
|---|---|---|---|
| 2,802,576 | 8/1957 | Kelling | 211/59.1 |
| 2,940,606 | 6/1960 | Kurnitz | 40/605 X |
| 3,495,717 | 2/1970 | Lavin et al. | 211/208 X |
| 3,766,675 | 10/1973 | Leigh | 40/605 |
| 3,778,915 | 12/1973 | Freeman et al. | 40/605 |
| 4,356,648 | 11/1982 | Beaulieu | 40/155 |
| 4,606,466 | 8/1986 | Fredrickson | 211/59.1 |
| 4,610,413 | 9/1986 | Pedersen | 211/59.1 |
| 4,790,091 | 12/1988 | Hull | 40/605 |

FOREIGN PATENT DOCUMENTS

| | | | |
|---|---|---|---|
| 535026 | 10/1931 | Fed. Rep. of Germany | 40/657 |
| 670162 | 1/1939 | Fed. Rep. of Germany | 40/155 |

*Primary Examiner*—Ramon O. Ramirez

*Attorney, Agent, or Firm*—Henry C. Kovar

[57] ABSTRACT

A pegbar display device has a pegbar and a display sign, the sign is a decour frame around a perimeter of the pegbar and is formed of several lengths of an extruded plastic channel and discrete connectors, the decour frame is held in position and supported by carrier pegs attachable to the pegbar. A method of providing this display sign is also provided.

20 Claims, 4 Drawing Sheets

DISPLAY DEVICE

BACKGROUND OF THE INVENTION

1. Field of the Invention

This invention pertains to a display sign for a pegbar type mechandiser, and to a pegbar device having a display sign.

2. The Prior Art

Signs for associated display with pegbar devices have usually been discrete and afterthought devices and intergrated systems have not been available.

M. J. Kelling, U.S. Pat. No. 2,802,576 of Aug. 13, 1957 has horizontal logo carrying strips within the confines of an exterior frame.

B. B. Lavin et al, U.S. Pat. No. 3,495,717 of Feb. 17, 1970 has a discrete sign that mounts to a backboard plate and frames a plurality of pegs and goods upon the pegs. Lavin is the most pertinent known prior art.

B. L. Garfinckle International Application W082/03321 published on 14 Oct. 1982 has a horizontal logo carrier which is suspended from a supporting pegbar. The support rods have upward offsets.

H. J. Fredrickson, U.S. Pat. No. 4,606,466 has a horizontal logo carrier which is suspended as a unit and can be installed or removed without disturbing goods on the pegs and without requiring additional space as in the case with Garfinckle.

None of this prior art has provided for a circumferential display sign that will promote goods on all pegs and which is an integral system component.

OBJECTS OF THE INVENTION

It is an object of this invention to provide a pegbar type display device having a new and improved display sign with a circumferential decour frame enclosing the package supporting pegs.

It is an object of this invention to provide a new and improved pegbar decour frame.

It is an object of this invention to provide a new and improved method of providing a display sign for a pepgbar.

SUMMARY OF THE INVENTION

A pegbar type display device has a plurality of elongate pegs for support of goods thereon, peg support structure, a decour frame forward of the support structure and around the pegs, and frame carrying pegs securing the decour frame to the support structure.

A pegbar decour frame has elongate upper, bottom and side channels, four discrete corner connectors, structure on the front for presenting indicia, and structure on the back being located and supported by pegs.

A method of providing a pegbar with a display sign has the steps of providing at least four elongate lengths of decour channels, an upper carrier peg, a bottom carrier peg, two side carrier pegs and four discrete corner connectors, installing the carrier pegs on the pegbar, installing the upper and bottom channels on the upper and bottom carrier pegs, installing the corner connectors, installing the side channels on the side carrier pegs and connecting the side channels to the corner connectors, positioning the now assembled decour frame and then tightening each carrier peg to the decour frame.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
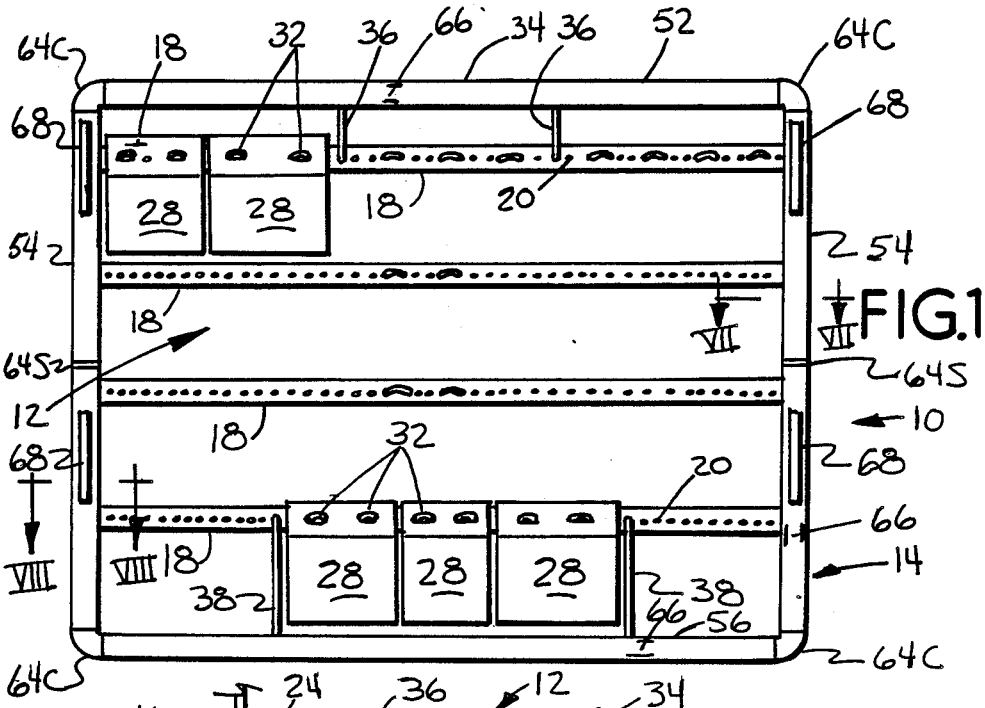
FIG. 1 is a front elevational view of a pegbar display device with the preferred embodiment of a display sign according to the present invention.
Figure 2:
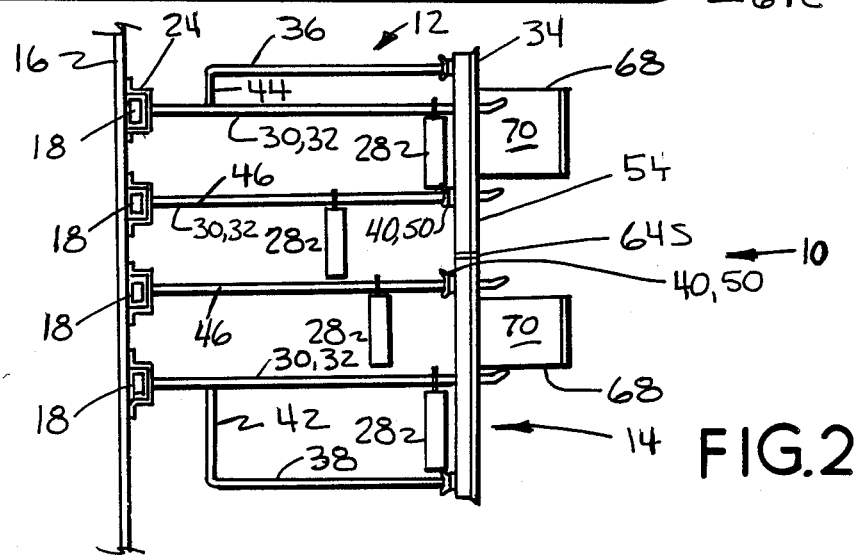
FIG. 2 is an elevational view of the left end of the structure of FIG. 1.

A point-of-purchase display device as is shown in FIG. 1 and generally indicated by the numeral 10 and hereafter simply referred to as the display 10. The display 10 has a pegbar display device generally indicated by the numeral 12 and hereinafter referred to as the pegbar 12, and a new and novel display sign generally indicated by the numeral 14. The pegbar 12 and the display sign 14 are usually mounted upon or adjacent to some type of a backboard 16.

The basic pegbar 12 is completely disclosed in commonly owned Gerald D. Pedersen's U.S. Pat. No. 4,610,413 of Sept. 9, 1986 and the teachings therein are incorporated hereinto by reference. The pegbar 12 as shown herein has a plurality of elongate peg support bars 18. Each support bar 18 is preferrably a hollow and rectangular cross-sectional tube having a line of front keyholes 20 and a corresponding line of rear backbores 22. The support bars 18 are preferrably mounted parallel to and spaced from each other and preferrably are positioned generally horizontal.

Figure 5:
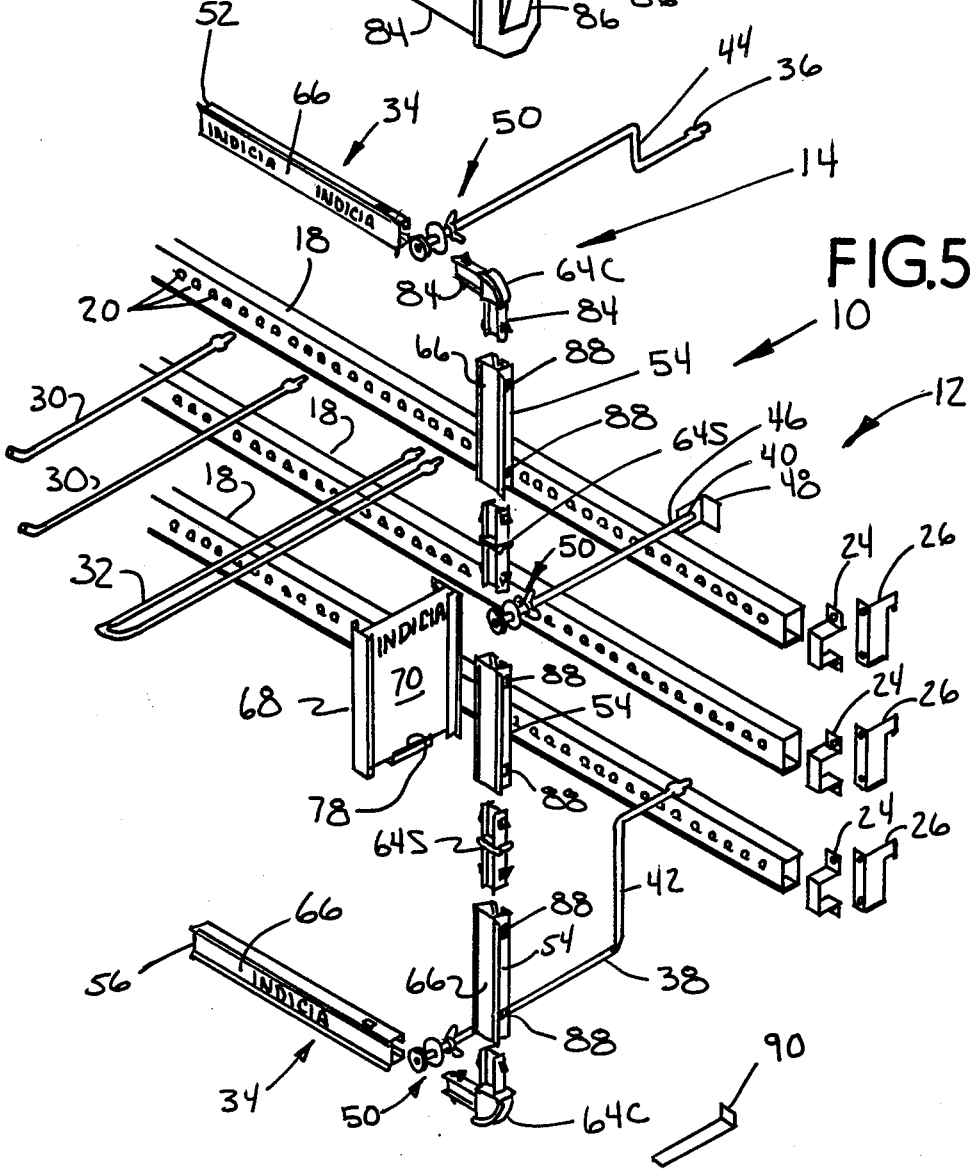
FIG. 5 is a blown-up perspective view of the componentry of the structure of FIG. 1.
Figure 6:
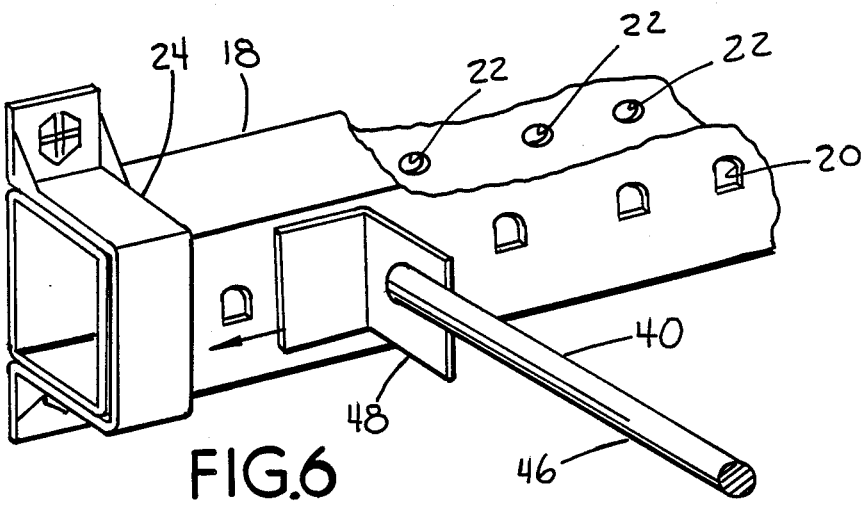
FIG. 6 is a detail perspective of part of the structure of FIG. 1.

Each support bar 18 is held on its opposite ends by a pair of clamps 24 which may be fastened directly to the backboard 16, or to intermediate mounting brackets 26, or directly to a base frame (not shown). The support bars 18 are vertically spaced from each other a distance corresponding to the height of a goods or package 28 to be displayed, plus a nominal amount of clearance. There are, at this time, two preferred pegs to be utilized in the pegbar 12. The single peg 30 shown best in FIG. 5 is fully disclosed and explained in aforementioned Pedersen U.S. Pat. No. 4,610,413. The double strength U-shaped peg 32 is subject of a commonly owned U.S. patent application.

Figure 3:
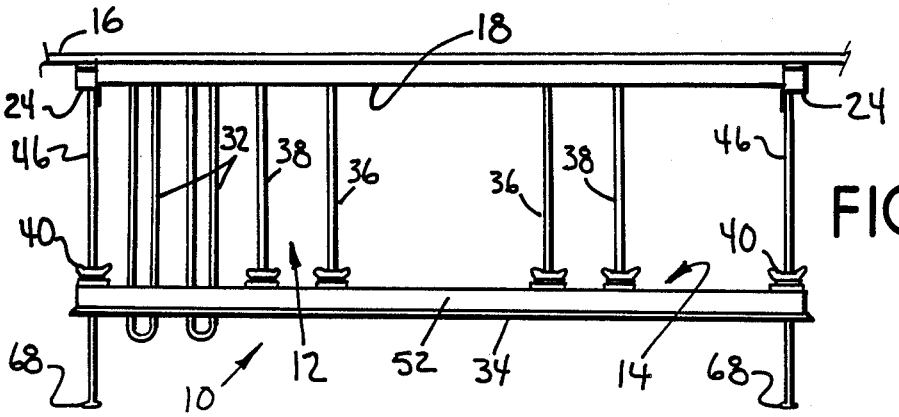
FIG. 3 is a top plan view of the structure of FIG. 1.

The display sign 14 has a decour frame 34 which is held in front of the support bars 18 by upper frame carrier pegs 36, lower frame carrier pegs 38 and side frame carrier pegs 40. Each upper carrier peg 36 is essentially identical to the peg shown in FIG. 3 of Fredrickson's U.S. Pat. No. 4,606,466. Each lower carrier peg 38 is similar to Fredrickson's FIG. 3 but has a downward offset instead of an upward offset. The downward offset of the lower carrier peg 38 as defined by the length of the central upright 42 is preferrably greater than the upright offset of the upper carrier peg 36 as defined by its central upright 44. The side carrier pegs 40 each have a generally straight body 46 with an L-shaped sheet metal foot 48 that slips under and is held by a respective clamp 24 against the front surface of a respective support bar 18. Each of the carrier pegs 36, 38, 40 has an outer end 50 which is shown in detail in FIGS. 3 & 5 of Fredrickson's U.S. Pat. No. 4,606,466, the carrier pegs 36, 38, 40 are preferrably arranged so that there are a pair of spaced apart upper carrier pegs 36, a pair of spaced apart lower carrier pegs 38, and at least one and sometimes two side carrier pegs 40 on each side of the display 10.

Figure 4:
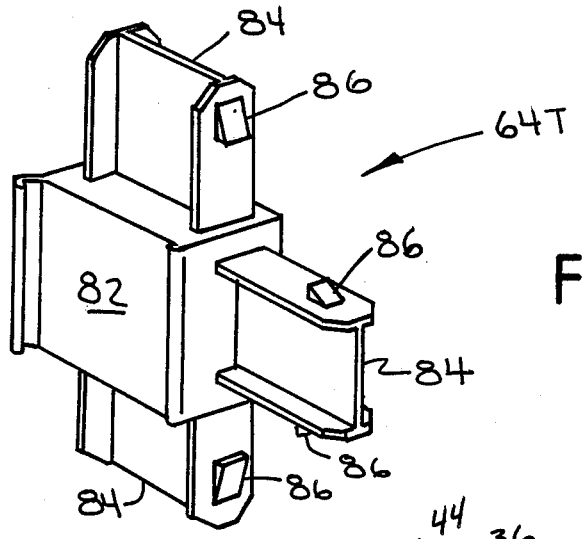
FIG. 4 is a perspective view of a sign frame connector of the structure of FIG. 1.
Figure 8:
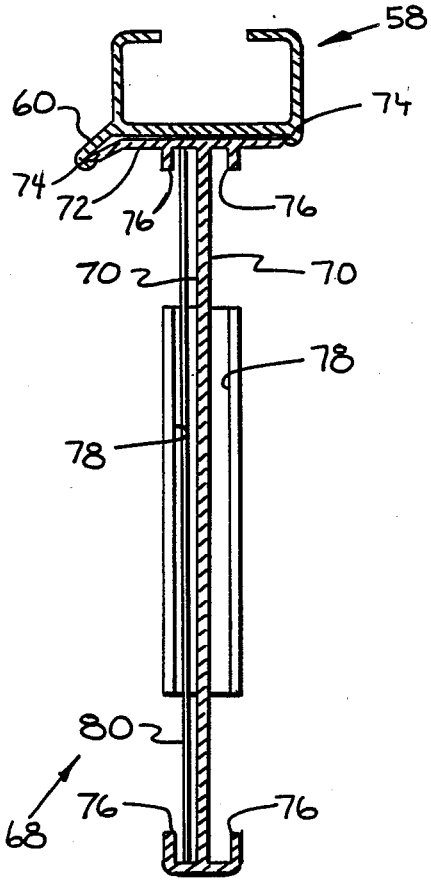
FIG. 8 is a cross-sectional view through lines VIII—VIII of FIG. 1.
Figure 7:
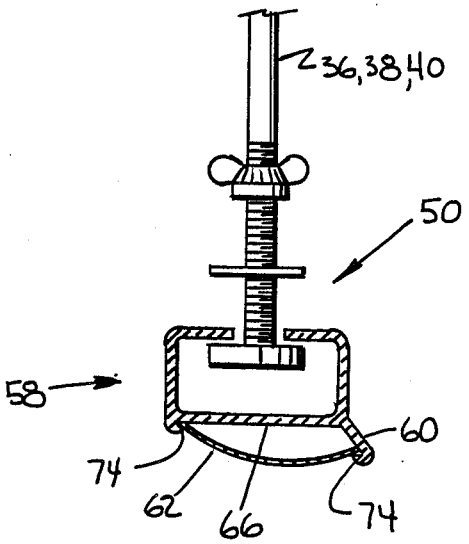
FIG. 7 is a cross-sectional view through lines VII—VII of FIG. 1.

The decour frame 34 is a multiple piece composite assembly of several pieces, enabling economical packaging, distribution, set-up and variation in relatively larger or smaller sizes as desired. The decour frame 34 usually surrounds all of the pegs 30, 32 and any packages 28 thereon. The decour frame 34 has an upper channel 52 which is elevated and held above the top support bar 18 by the upper carrier pegs 36. The decour frame has a pair of opposed side channels 54 which are each outboard of pegs 30, 32 and keyholes 20 and which are flush on the outside with the outer ends of the bars 18 and the brackets 26 and clamps 24. The decour frame also has a bottom channel 56 which is suspended below the lowest bar 18 by the lower carrier pegs 38 a distance at least the height of the packages 28 to be displayed. The upper carrier pegs 36 are mounted in otherwise unused keyholes 20 in the top bar 18 and the lower carrier pegs 38 are mounted in otherwise unused keyholes 20 in the bottom bar 18. Each of the decour channels 52, 54, 56 is a discrete length of a common C-shaped plastic extrusion section 58 shown in cross-section in FIGS. 7 & 8. The section 58 has a forward extending outboard ear 60 which is intended to be on the outside of the frame 34 and which may help to hold an inward facing and optional price code (UPC) label 62. The decour frame 34 has a corner piece connector 64C at each corner. The vertical height of the decour frame 34 can be easily changed by utilizing one or more straight connectors 64S and two or more discrete lengths of channel section 58 as side channel portions 54 as shown in FIG. 5. A tee connector 64T is discretely shown in FIG. 4 and the use of two tee connectors 64T enables the placement of intermediate horizontal or vertical decour channels (not shown) within the decour frame 34. On the front of the channel section 58 is a forward facing face surface 66 that can be utilized for temporary or permanent promotional and/or pricing copy applied by hot stamp, screening, decal or other processes. A frame flag 68 having a two side generally flat and planar display board 70 has a snap in tongue 72 that snaps into the grooves 74 of the channel section 58. The flag 68 is also a plastic extrusion as shown in FIG. 8 and has full length card holders 76 and a welded on U-shape card support 78 to hold up promo copy cards 80 in the flag 68. The display board 70 can also have permanent or temporary promo copy applied thereto. The flags 68 can be slid up and down in the channel section 58 to any height on the side channels 54 or to any position on the upper or bottom channels 52, 56.

Each of the connectors 64C, S, T, has a central section 82 which compliments the exterior profile of the channel section 58, and at least two cantilevered connector stubs 84 which slip fit within the channel section 58. Each connector stub 84 has a pair of opposed connector snap latches 86 that pop into a respective pair of opposed apertures 88 in the ends of the upper, side and bottom channels 52, 54, 56. A generally L-shaped sheet metal tool 90 is provided to twist the channel section 58 for removal of any connector 64 C, S, T.

Figure 9:
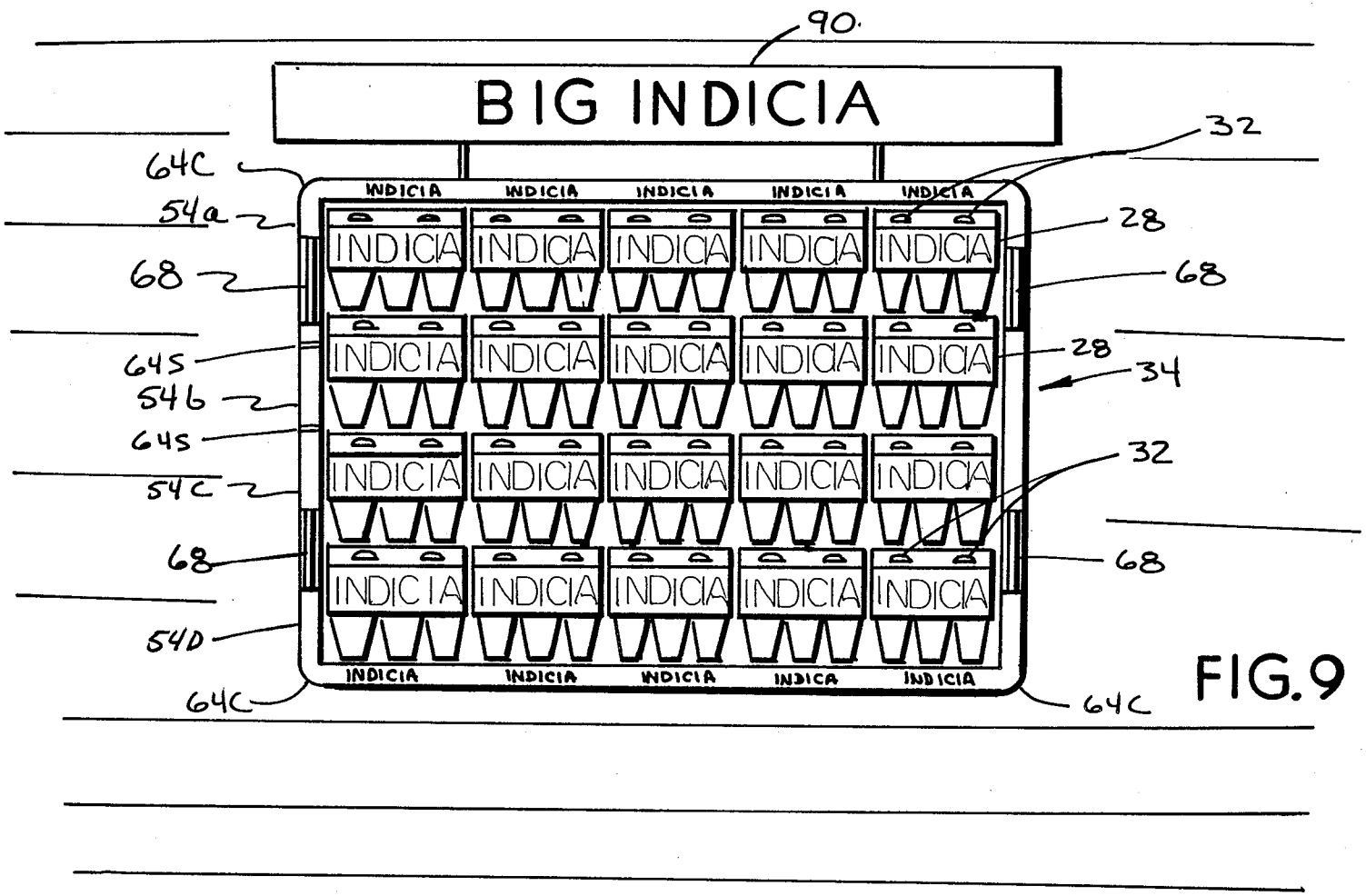
FIG. 9 is a front elevational view of the structure of FIG. 1 in use.

FIG. 9 illustrates the entire display 10 in use in a cold shelf refrigerated space in the typical dairy product section of a food retailer. The display 10 is surrounded by such products as milk, yogurt, juice, spreads and the like. In this usage the display sign 14 frames in and encloses an entire display of a specific product, in this case it happens to be 6 pacs of individual servings of pudding snacks sold under a very popular brand name. The double strength pegs 32 are used in a 10 by 4 level matrix to hold, support and display a 5 by 4 matrix of pudding 6 pac packages 28. An optional large overhead sign 92 may be secured to the uppermost pegbar in accordings with the teachings of my earlier H. J. Fredrickson U.S. Pat. No. 4,606,466 of Aug. 19, 1986, the teachings of which are hereinto by reference. The decour frame 34 may be bright red and visually accentuate and differentiate the enclosed product 28. The flags 68 project outward and enable location of the products 28 and/or promotion of the products 28 from anywhere in the appropriate aisle. The decour frame 34 complements and enhances the value of the products 28.

In the display 10 in FIGS. 9, each side channel 54 is comprised of four discrete short pieces 54*a, b, c, d* or channel section 58 and three straight connectors 64S to accomodate the four high matrix of product packages 28. By adding or deleting these short pieces 54*a, b, c, d* which are each precisely sized to correspond to the height of the packages 28, the decour frame 34, sign 14 and display can be shortened or lengthened as desired at the retailing situs.

This display 10 is of relatively low cost, is easily set up, can be sized as desired, and is gorgeous and a real eye catcher. It is safe and presents no hazard to shoppers or retailer employees.

Although other advantages may be found and realized and various modifications may be suggested by those versed in the art, it should be understood that I wish to embody within the scope of the patent warranted hereon, all such embodiments as reasonably and properly come within the scope of my contribution to the arts.

I claim as my invention:

1. A pegbar type display device comprising (a) a plurality of elongate pegs for support and display of goods thereon;

(b) peg supporting means for supporting said pegs and any goods thereon in a contiguous geometric form;

(c) an ornamental decour frame structurally separate from and surrounding said pegs and spaced forward of said supporting means; and (d) a plurality of structurally discrete frame carrying pegs, each carrying peg having an outer end fastener manually, removably and individually secured to said decour frame, and each carrying peg having an inner end fastener manually, removably and individually secured to said peg supporting means, for supporting said frame adjacent outer noses of said pegs, said frame and said carrying pegs being selectively installable upon and removable from said supporting means independently of said elongate pegs, said carrying pegs being individually selectively installable to and removable from said frame.

2. The display device of claim 1, in which said frame is spaced above a top level of elongate pegs, and is spaced below a bottom level of elongate pegs, with a frame top being secured to means for supporting said top level pegs and with a frame bottom being secured to means for supporting said bottom level pegs.

3. The display device of claim 2, in which upper said carrier pegs are offset upwardly and lower said carrier pegs are offset downwardly, said downwardly offset being greater than said upwardly offset.

4. The display device of claim 2, in which sides of said frame are secured to a central level peg support positioned at a level in between said top level supporting means and said bottom level supporting means.

5. The display device of claim 1, including a central level peg support and support fastening means for fastening said support to back structure therefore, and in which upright sides of said frame are secured by said support fastening means.

6. The display of claim 5, in which said support fastening means are a pair of clamps, and in which said frame upright sides are secured by side frame carrier pegs which each have a foot held by a respective clamp.

7. The display device of claim 1, including flag means on the front of said frame for presenting indicia outward of and normal to a front surface of said frame.

8. The display device of claim 7, including card holder structure in said flag means, for holding a card outward of said frame front surface.

9. The display device of claim 7, including snap structure between said frame and said flag means for snap assembling said flag means to said frame.

10. The display device of claim 7, in which said elongate pegs extend outward of said frame, and in which said flag means extend outward of said elongate pegs.

11. A pegbar decour frame comprising (a) an elongate upper channel;

(b) an elongate bottom channel;

(c) a pair of elongate side channels, all of said channels being of generally identical cross section;

(d) four discrete corner connectors, each connector having a central section complementary to all of said channels, each connector having a pair of connector stubs, each of said stubs being connectible to a respective channel;

(e) means on a front side of the frame for outwardly presenting indicia;

(f) supporting means on a back side of the frame for supporting and locating the frame; and (g) at least one discrete frame carrying peg for each of said channels, each carrying peg having a manually operable outer end fastener selectively securable to a respective said channel, and an inner end fastener manually securable directly to a peg support structure.

12. The decour frame of claim 11, in which each end of each channel has at least one-half of a snap fastener therein, and in which each stub has a complementary one-half of the snap fastener therein.

13. The decour frame of claim 11, in which each carrying peg is both rotatably and slidably mounted in a respective one of said channels.

14. The decour frame of claim 11, including flag means secured to said frame and extending forward normal to the front side of the frame, for the presentation of indicia forward of said frame.

15. The decour frame of claim 14, including card holder structure in said flag means.

16. A pegbar decour frame comprising (a) an elongate upper channel;

(b) an elongate bottom channel;

(c) a pair of elongate side channels, all of said channels being of generally identical cross section;

(d) four discrete corner connectors, each connector having a central section complementary to all of said channels, each connector having a pair of connector stubs, each of said stubs being connectible to a respective channel;

(e) means on a front side of the frame for presenting outward facing indicia;

(f) means on a back side of the frame for supporting and locating the frame with pegs; and (g) flag means connectible to at least one of said channels for presenting indicia outward of and generally perpendicular to said frame front side.

17. The decour frame of claim 16, including card holding means in said flag means for presentation of indicia cards to the front of said channels.

18. The decour frame of claim 17, in which said card holding means comprise front and rear upright tracks, and a card support adjacent a bottom of said holding means.

19. The decour frame of claim 16, including a pair of said flag means mounted to each said side channel.

20. The decour frame of claim 19, in which said flags are parallel to each other.

* * * * *